US005695172A

United States Patent [19]

Hreha

[11] Patent Number: 5,695,172

[45] Date of Patent: Dec. 9, 1997

[54] PANEL LIFTER PRY BAR

[75] Inventor: Kenneth W. Hreha, Tullahoma, Tenn.

[73] Assignee: The Stanley Works, New Britain, Conn.

[21] Appl. No.: 702,935

[22] Filed: Aug. 28, 1996

[51] Int. Cl.[6] ..... B66F 15/00

[52] U.S. Cl. ..... 254/25; 254/21; 254/22; 254/18; 254/27

[58] Field of Search ..... 254/18, 21, 22, 254/19, 25, 27, 26 R, 28

[56] References Cited

U.S. PATENT DOCUMENTS

| | | | |
|---|---|---|---|
| 96,700 | 11/1869 | Howard . | |
| D. 103,141 | 3/1937 | White . | |
| D. 158,110 | 4/1950 | Lutz . | |
| D. 197,205 | 12/1963 | Estwing . | |
| D. 202,475 | 10/1965 | Anderton . | |
| D. 211,755 | 7/1968 | Yeager . | |
| D. 263,673 | 4/1982 | Sheehan . | |
| D. 337,492 | 7/1993 | Ryan et al. . | |
| D. 348,595 | 7/1994 | Kusner . | |
| 886,987 | 5/1908 | Kiehle | 254/25 |
| 1,221,323 | 4/1917 | Hill | 254/25 |
| 1,270,970 | 7/1918 | Rich . | |
| 1,486,820 | 3/1924 | Wilder . | |
| 1,508,489 | 9/1924 | Vlchek | 254/25 |
| 1,890,273 | 12/1932 | Wells . | |
| 2,087,148 | 7/1937 | Hempy . | |
| 2,373,898 | 4/1945 | Kulesh . | |
| 2,569,242 | 9/1951 | Kors . | |
| 2,863,635 | 12/1958 | Fandrich | 254/25 |
| 2,896,910 | 7/1959 | Cooper et al. | 254/25 |
| 3,134,574 | 5/1964 | Reuterfors . | |
| 3,522,932 | 8/1970 | Nakasone | 254/25 |
| 3,587,121 | 6/1971 | Morrow . | |
| 4,183,503 | 1/1980 | Ward . | |
| 4,844,416 | 7/1989 | Hand | 254/25 |
| 4,868,943 | 9/1989 | Robichaud . | |
| 4,884,416 | 12/1989 | Hand . | |

*Primary Examiner*—Timothy V. Eley
*Assistant Examiner*—Lee Wilson
*Attorney, Agent, or Firm*—Pepe & Hazard

[57] ABSTRACT

A panel lifter pry bar comprises an integrally formed elongated bar with an elongated substantially rectilinear shank portion having a U-shaped portion at one end disposed to one side of the longitudinal axis of the shank portion, and an inverted U-shaped portion at the other end disposed to the other side of the longitudinal axis. At the end of the U-shaped portion spaced from the shank portion is a claw, and at the end of the inverted U-shaped portion, is an elongated panel lifter portion which extends at an obtuse angle to the shank portion. The U-shaped and inverted U-shaped portions provide fulcrums on opposite sides of the longitudinal axis of the shank portion for the claw and panel lifter portions respectively.

16 Claims, 3 Drawing Sheets

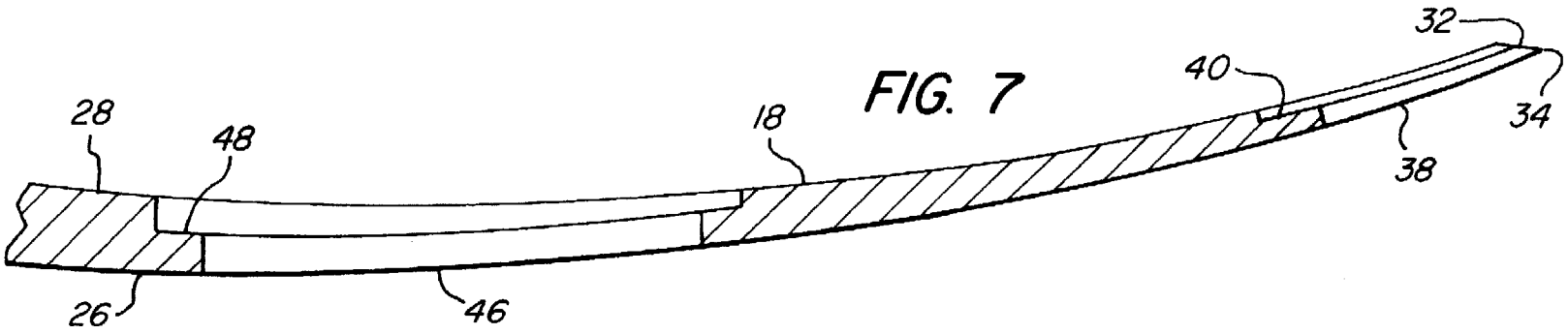
FIG. 7
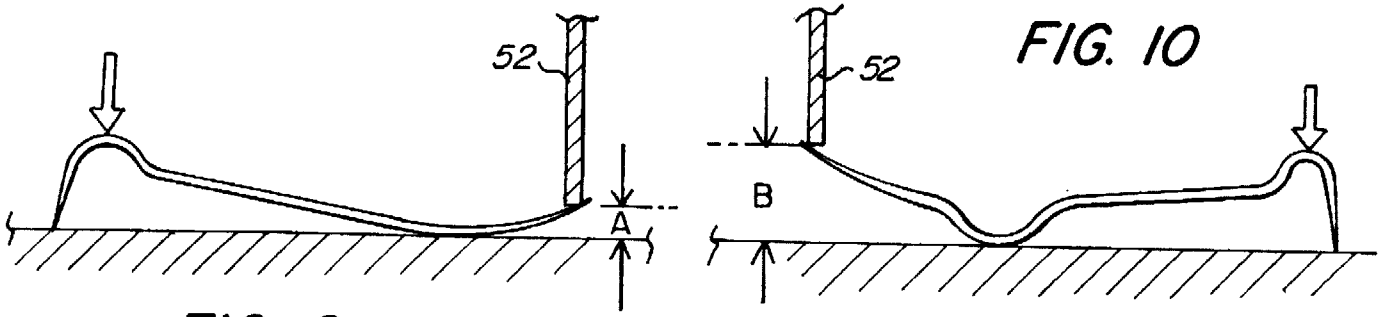
FIG. 10
FIG. 9
(PRIOR ART)
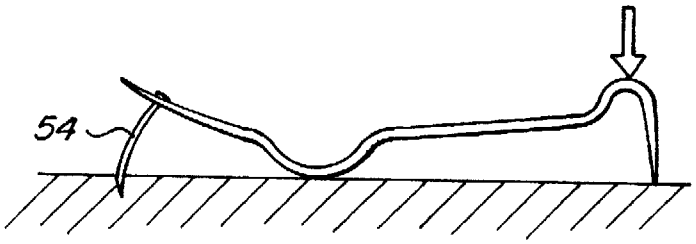
FIG. 11
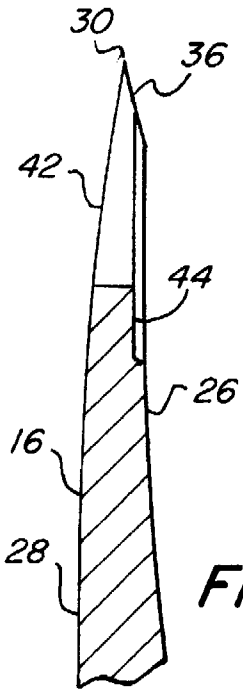
FIG. 8

PANEL LIFTER PRY BAR

BACKGROUND OF THE INVENTION

The present invention relates to pry bars, and, more particularly, to pry bars for extracting driven nails and for lifting wall panels during installation.

Pry bars are sometimes employed to support and position a wall board or panel as it is being installed against framing above floor level in a vertical position. With a panel vertically in place on the upper portion of the framing, a pry bar may be used to lift the lower panel seated on the floor tightly against the upper panel. The pry bar generally has a claw end with a fulcrum so that depressing the other end will pivot the claw end upwardly to extract a nail or pry one member from another. When the claw end is inserted under a panel, the user steps or bears down on the raised end of the lever in order to position the lower panel tightly against an upper panel.

Exemplary of such tools are Reutefors U.S. Pat. No. 3,134,574, Hand U.S. Patent No. 4,844,416 and Cooper U.S. Pat. No. 2,896,910. Such pry bars are generally limited as to the amount of lift and, in order to achieve greater vertical travel, it is often necessary to increase the fulcrum height by placing a block underneath the fulcrum bearing surface. However, an appropriately sized block may not be readily available, and even if one is available, the use of a block to prop up the pry bar makes the raising process relatively more unstable since the block may slip out from underneath the pry bar if it is not carefully and securely placed thereunder. In addition, the rugged, relatively thick configuration of the claw limits the ability to insert it under the panel without damaging the edge.

It is an object of the present invention to provide a novel panel lifter pry bar which affords a substantial amount of lift for a panel under which it is engaged and which will also provide a rugged claw for nail removal and demolition use.

It is also an object to provide such a panel lifter pry bar which is integrally formed from metal bar stock with a panel lifter and which is configured to minimize the potential for damage to the panel.

Another object is to provide such a panel lifter pry bar which incorporates both a claw blade and a lifting blade at opposite ends thereof.

A further object is to provide such a panel lifter pry bar which may be fabricated relatively easily and economically.

SUMMARY OF THE INVENTION

It has now been found that the foregoing and related objects may be readily attained in a panel lifter pry bar which comprises an integrally formed elongated bar having two ends and opposite side surfaces and edges extending therebetween. The bar has an elongated substantially rectilinear shank portion intermediate the length thereof and opposite ends. The opposite side surfaces define upward and downward reference planes. A concave U-shaped portion is at one end of the shank portion and extends downwardly of the longitudinal axis of the shank portion, and an inverted U-shaped portion at is the other end and extends upwardly of the other side of the longitudinal axis. At the end of the U-shaped portion spaced from the shank portion is a claw portion, and at the end of the inverted U-shaped portion is an elongated panel lifter portion. A reversely curved transitional portion connects the panel lifter portion to the inverted U-shaped portion at its end spaced from the shank portion, and the panel lifter portion extends at an obtuse angle to the shank portion. The U-shaped and inverted U-shaped portions provide fulcrums on opposite sides of the longitudinal axis of the shank portion for the claw and panel lifter portions respectively.

Generally, the claw portion extends substantially perpendicularly to the longitudinal axis of the shank portion. Preferably, the panel lifter portion is convexly arcuate along its longitudinal axis i.e., the arc is being concave in the direction of extension of the lifter portion from the inverted U-shaped portion. The included angle between an imaginary chord drawn between the ends of the panel lifter portion and the longitudinal axis of the shank portion is about 25°–50°.

The claw and panel lifter portions are on opposite sides of the longitudinal axis of the shank portion, and the surfaces of the elongated bar are preferably generally smooth. The claw and panel lifter portions taper to a reduced thickness at the outer ends thereof, and also flare outwardly to an increased width at the outer ends thereof. The outer end of the panel lifter portion has a tapered edge.

The claw and panel lifter portions include notches in their outer ends, and the panel lifter portion has an aperture therein intermediate its length for engagement of nails and the like therein.

BRIEF DESCRIPTION OF THE DRAWINGS

FIG. 7 is a sectional view of the panel lifter blade portion along the line 7—7 of FIG. 5 and drawn to a greatly enlarged scale;

FIG. 8 is a sectional view of the claw blade along the line 8—8 of FIG. 6 and drawn to a greatly enlarged scale;

FIG. 9 is a side elevational view of a prior art pry bar with an arrow showing force being applied to the claw end, and a panel being raised thereby;

FIG. 10 is a view similar to FIG. 9 of the pry bar embodying the present invention; and FIG. 11 is a view similar to FIG. 10 of a driven nail being extracted by the lifter blade portion.

DETAILED DESCRIPTION OF THE PREFERRED EMBODIMENT

Figure 1:
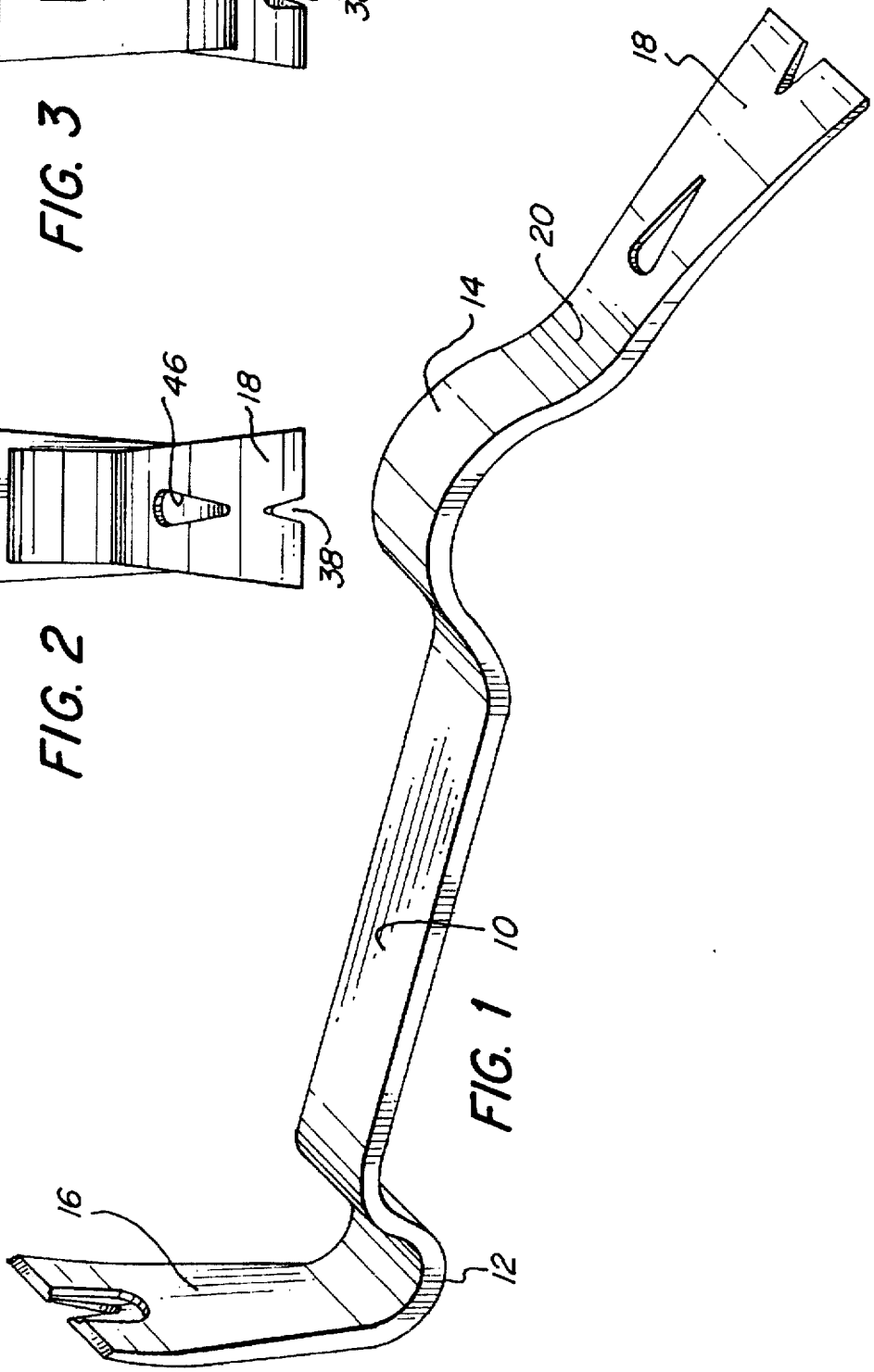
FIG. 1 is a perspective view of a panel lifter pry bar embodying the present invention.

Turning first to FIG. 1, therein illustrated is a panel lifter pry bar embodying the present invention which is formed from an elongated planar metal bar having opposite side surfaces A and B and edges extending between its ends. For purposes of orientation, the side surface A represents an upward reference plane and the side surface B represents a downward reference plane. The bar is bent along its length to provide an elongated shank portion 10 having a concave U-shaped portion 12 and a convex inverted U-shaped portion 14 at the ends thereof which extend respectively below the downward reference plane and above the upward reference plane of the shank portion 10. The U-shaped portion 12 and inverted U-shaped portion 14 are connected to the ends of the shank portion 10 by reversely curved transitional portions 22, 24 respectively, and the shank portion 10 is generally rectilinear. This configuration is relatively simple to form and reduces stress concentration at these junctions when stress is applied to the bar.

Figure 4:
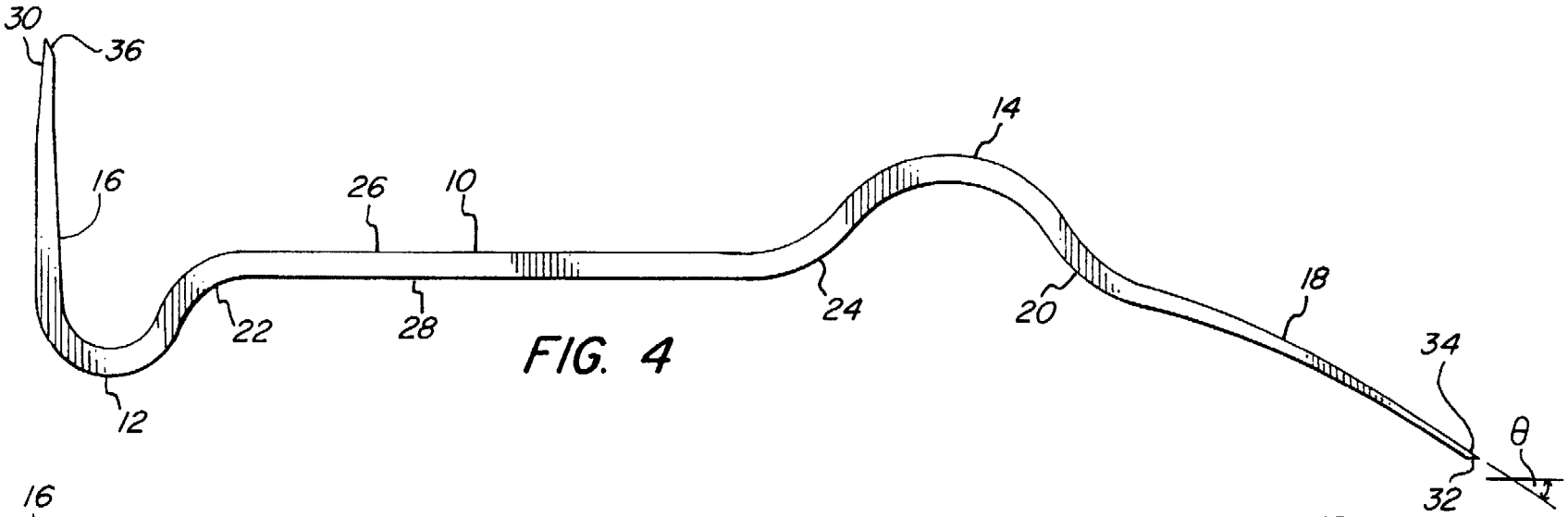
FIG. 4 is a side elevational view.
Figure 5:
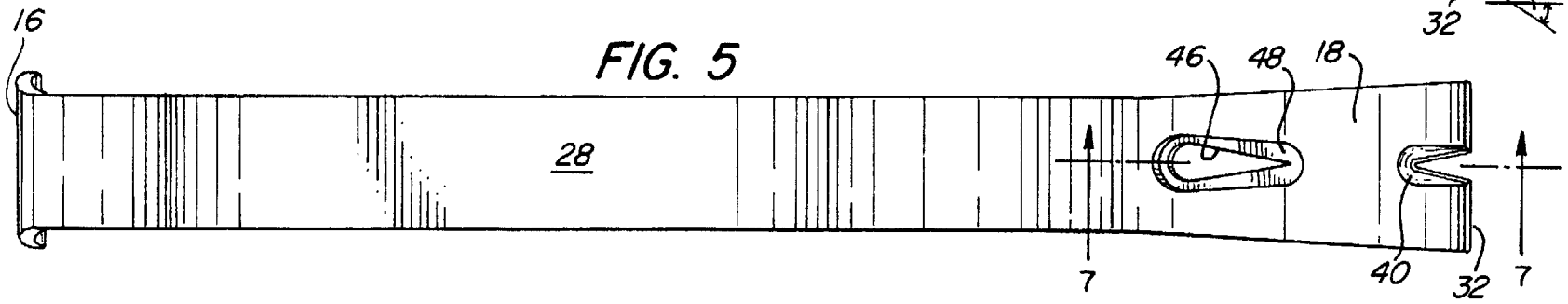
FIG. 5 is a bottom view.
Figure 6:
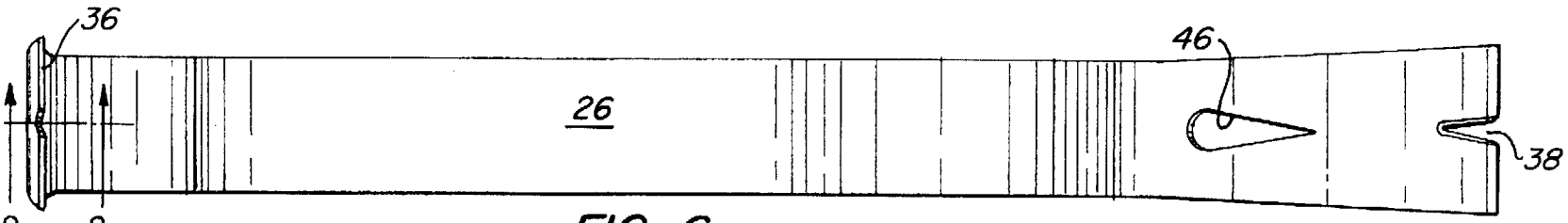
FIG. 6 is a top plan view of the pry bar.

A claw portion 16 is formed on the end of the U-shaped portion 12 spaced from the shank portion 10, and it extends substantially perpendicularly to the longitudinal axis of the shank portion 10. An elongated panel lifter portion 18 is connected by a reversely curved transitional portion 20 to the end of the inverted U-shaped portion 14. As best illustrated in FIG. 4, the panel lifter portion 18 extends downwardly at an obtuse angle to the longitudinal axis of the shank portion 10. The panel lifter portion 18 is arcuate along its longitudinal axis, with the arc being concave in the direction of the extension of the lifter portion 18 away from the inverted U-shaped portion 14. As seen in FIG. 4, the included angle θ between the an imaginary chord drawn between the ends of the arcuate panel lifter portion 18 and the longitudinal axis of the shank portion 10 is approximately 30°, although it may generally range between 25°–50°. The claw portion 16 and panel lifter portion 18 are on opposite sides of the longitudinal axis of the shank portion 10.

The thickness of the pry bar is generally uniform over most of its length, but tapers to a reduced thickness at the outer ends 30, 34 of the claw portion 16 and panel lifter portions 18, respectively, to facilitate insertion of either portion into tight cracks or crevices between surfaces or to pry under a nail. In addition, the tips of the outer end portions 30, 34 are beveled at 32, 36 to further facilitate insertion under surfaces.

Figure 3:
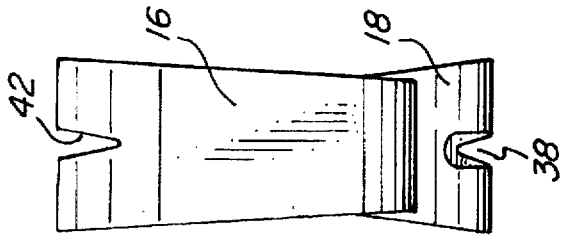
FIG. 3 is an end view of the claw end with the bar inverted.
Figure 2:
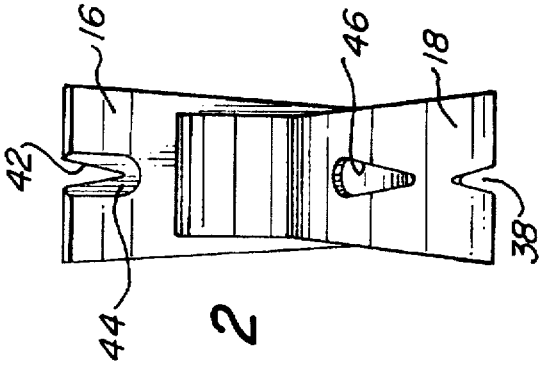
FIG. 2 is an end view of the lifter end of the panel lifter pry bar

As best illustrated in FIGS. 2 and 3, both the claw 16 and panel lifter 18 portions flare outwardly to an increased width at the outer ends 30, 34 thereof to form a chisel-like prying member at either end of the pry bar. Also, both outer ends 30, 34 include inwardly extending V-shaped notches 42, 40 for seating the heads of nails. The panel lifter portion 18 further includes tear-drop shaped, longitudinally extending aperture 46 intermediate its length for seating the heads of nails. Both the notches 38, 42 and aperture 46 all have recesses thereabout to provide flat surfaces 40, 44, 48 to seat the head of a nail, as best illustrated in FIGS. 2, 3, 5, 7 and 8. The flat surface 44 is formed on the side 26 as illustrated in FIGS. 8, and the surfaces 40, 48 are formed on the opposite side 28 as illustrated in FIG. 7.

In operation, the concave upper surface 28 of the lifter portion 18 is inserted underneath the bottom of a panel 52 as illustrated in FIG. 10. The U-shaped portion 14 provides a large arcuate fulcrum which enables the panel lifter pry bar of the present invention to lift the panel 52 to a height designated "B" by applying opposite end of the bar.

A prior art pry bar which does not include the large arcuate fulcrum of the present invention is illustrated in FIG. 9. In contrast to the bar of the present invention, the prior art pry bar is merely capable of lifting the panel 52 a height designated "A" which is less than one-third of the height lifting capability "B" of the bar of the present invention illustrated in FIG. 10.

As illustrated in FIG. 11, the panel lifting portion 18 of the pry bar of the present invention may also be used to extract nails 54 further than the prior art pry bar because of the greater vertical travel provided to the panel lifter portion 14 by the large arcuate fulcrum 14.

Although various materials may be employed for the construction of the bar, it is preferably formed from hardened steel for maximum dimensional stability and long life.

Thus, it can be seen that a novel panel lifting pry bar affords a relatively large vertical movement and good leverage during the lifting of a panel. It also provides good leverage and a large amount of vertical movement during the extraction of a driven nail. It can be fabricated relatively easily and economically from bar stock to provide a long lived multipurpose tool.

Having thus described the invention, what is claimed is:

1. A panel lifter pry bar comprising an integrally formed elongated bar having two ends and first and second opposite side surfaces and edges extending therebetween, said bar comprising:

(a) an elongated substantially rectilinear shank portion intermediate the length thereof with opposite ends, said shank portion having a longitudinal axis extending between said ends, said first side surface of said shank portion defining a reference plane disposed upwardly and said second side surface of said shank portion defining a reference plane disposed downwardly;

(b) a concave, U-shaped portion at one end of said shank portion extending downwardly of said downward reference plane, said U-shaped portion having opposite ends, one of which is joined to one of said opposite ends of said shank portion;

(c) a convex inverted U-shaped portion at the other of said opposite ends of said shank portion and extending upwardly from said upward reference plane, said inverted U-shaped portion having opposite ends, one of which is joined to the other of said opposite ends of said shank portion;

(d) a claw portion on the other of said opposite ends of said U-shaped portion and extending upwardly of said upward reference plane; and (e) an elongated panel lifter portion to the other of said opposite ends of said inverted U-shaped portion and extending at an angle downwardly of said downward reference plane, said U-shaped and inverted U-shaped portions providing fulcrums for said claw and panel lifter portions respectively on opposite sides of said reference planes of said shank portion.

2. The pry bar in accordance with claim 1 wherein said claw portion extends substantially perpendicularly to said longitudinal axis of said shank portion.

3. The pry bar in accordance with claim 1 wherein said panel lifter portion is convexly arcuate along its longitudinal axis relative to said upward reference plane.

4. The pry bar in accordance with claim 3 wherein the included angle between an imaginary chord drawn between the ends of said panel lifter portion and said longitudinal axis of said shank portion is about 25°–50°.

5. The pry bar in accordance with claim 1 wherein said claw and panel lifter portions extended to opposite sides of the longitudinal axis of said shank portion.

6. The pry bar in accordance with claim 1 wherein said opposite side surfaces of said elongated bar are generally smooth.

7. The pry bar in accordance with claim 1 wherein the thickness of said claw and panel lifter portions taper to a reduced thickness at said other ends thereof.

8. The pry bar in accordance with claim 1 wherein said claw and panel lifter portions flare outwardly to an increased width at said other ends thereof.

9. The pry bar in accordance with claim 1 wherein said claw and panel lifter portions include notches in said other ends thereof for engagement of nails therein.

10. The pry bar in accordance with claim 1 wherein said panel portion has an aperture therein intermediate its ends for engagement of nails.

11. The pry bar in accordance with claim 1 wherein said other end of said panel lifter portion has a tapered edge.

12. A panel lifter pry bar comprising an integrally formed elongated bar having two ends and first and second opposite side surfaces and edges extending therebetween, said bar comprising:

(a) an elongated substantially rectilinear shank portion intermediate the length thereof with opposite ends, said shank portion having a longitudinal axis extending between said ends, said first side surface of said shank portion defining a reference plane disposed upwardly and said second side surface of said shank portion defining a reference plane disposed downwardly;

(b) a concave, U-shaped portion at one end of said shank portion extending downwardly of said downward reference plane, said U-shaped portion having oppositene of which is joined to one of said opposite ends of said shank portion;

(c) a convex, inverted U-shaped portion at the other of said opposite ends of said shank portion and extending upwardly from said upwardly reference plane, said inverted U-shaped portion having opposite ends, one of which is joined to the other of said opposite ends of said shank portion;

(d) a claw portion on the other of said opposite ends of said U-shaped portion and extending upwardly of said upward reference plane; and (e) an elongated panel lifter portion to the other of said ends of said inverted U-shaped portion and extending at an angle downwardly of said downward reference plan, said U-shaped and inverted U-shaped portions providing fulcrums for said claw and panel lifter portions respectively on opposite sides of said reference planes of said shank portion, said claw portion extending substantially perpendicularly to said longitudinally axis of said shank portion, said panel lifter portion being convex arcuate along its longitudinal axis relative to said upward reference plane, said claw and panel lifter portions extending to opposite sides of said longitudinal axis of said shank portion.

13. The pry bar in accordance with claim 12 wherein the included angle between an imaginary chord drawn between the ends of said panel lifter portion and said longitudinal axis of said shank portion is about 25°–50°.

14. The pry bar in accordance with claim 12 wherein said opposite surfaces of said elongated bar are generally smooth, the thickness of said claw and panel liter portions tapers to a reduced thickness at said other ends thereof, and said claw and panel lifter portions flare outwardly to an increased width at said other ends thereof.

15. The pry bar in accordance with claim 12 wherein said claw and panel lifter portions include notches in said other ends thereof for engagement of nails and said panel portion has an aperture therein intermediate its ends for engagement of nails.

16. The pry bar in accordance with claim 12 wherein said other end of said panel lifter portion has a tapered edge.

* * * * *

UNITED STATES PATENT AND TRADEMARK OFFICE
CERTIFICATE OF CORRECTION

PATENT NO. : 5,695,172
DATED : December 9, 1997
INVENTOR(S) : Kenneth W. Hreha

It is certified that error appears in the above-identified patent and that said Letters Patent is hereby corrected as shown below:

Column 5, line 16, delete "oppositene" and insert --opposite ends, one--.

column 6, line 1, delete "plan" and insert --plane--.

Column 6, line 6, delete "longitudinally" and insert --longitudinal--.

Column 6, line 18, delete "liter" and insert --lifter--.

Signed and Sealed this

Twenty-fourth Day of March, 1998

*Attest:*

Bruce Lehman

BRUCE LEHMAN

*Attesting Officer*

*Commissioner of Patents and Trademarks*